US010908550B2

(12) United States Patent
Kanno

(10) Patent No.: US 10,908,550 B2
(45) Date of Patent: Feb. 2, 2021

(54) IMAGE FORMING APPARATUS

(71) Applicant: CANON KABUSHIKI KAISHA, Tokyo (JP)

(72) Inventor: Takashi Kanno, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/829,641

(22) Filed: Mar. 25, 2020

(65) Prior Publication Data

US 2020/0310327 A1 Oct. 1, 2020

(30) Foreign Application Priority Data

Apr. 1, 2019 (JP) ..... 2019-069597

(51) Int. Cl.
*G03G 15/00* (2006.01)
*G03G 21/16* (2006.01)

(52) U.S. Cl.
CPC ..... *G03G 15/80* (2013.01); *G03G 21/1647* (2013.01); *G03G 21/1652* (2013.01); *G03G 2221/166* (2013.01)

(58) Field of Classification Search
CPC ..... G03G 15/80; G03G 21/1647; G03G 21/1652; G03G 2221/166
See application file for complete search history.

(56) References Cited

U.S. PATENT DOCUMENTS

2016/0274529 A1* 9/2016 Yoshikawa ..... B41J 29/02
2017/0139369 A1* 5/2017 Matsuno ..... H04N 1/00551
2018/0103542 A1* 4/2018 Shinotsuka ..... G03G 21/1652

FOREIGN PATENT DOCUMENTS

JP 2007-148067 6/2007

* cited by examiner

*Primary Examiner* — Joseph S Wong
(74) *Attorney, Agent, or Firm* — Venable LLP

(57) ABSTRACT

An image forming apparatus, including: a main body including a rear face cover; a photosensitive member on which an image is formed; a transfer unit configured to transfer the image onto a sheet; a motor supported by a rear plate of the main body and configured to rotate the photosensitive member; a box made of metal fixed to a fixing portion of the main body with a screw and located between the rear face cover and the motor; a first circuit board provided in the box; a second circuit board provided outside the box; and a flexible flat cable configured to connect the first circuit board and the second circuit board, wherein, with the flexible flat cable connecting the first circuit board and the second circuit board, a position of the screw overlaps with the flexible flat cable in a direction orthogonal to the first circuit board.

10 Claims, 5 Drawing Sheets

IMAGE FORMING APPARATUS

BACKGROUND OF THE INVENTION

Field of the Invention

The present invention relates to an image forming apparatus including an electric component box removably fixed to a main body.

Description of the Related Art

An image data generating circuit board configured to generate image data, which is used in an image forming apparatus, radiates electromagnetic wave or is susceptible to noise caused by the electromagnetic wave. Therefore, the image data generating circuit board is accommodated in an electric component box made of metal, and the electric component box is mounted to a rear portion of an image forming apparatus. In Japanese Patent Application Laid-Open No. 2007-148067, there is disclosed an electric component box of a single swing door type that is openable and closable at a closed position and an open position with respect to a rear portion of an image forming apparatus. The electric component box is opened to the open position so that maintenance work for the image data generating circuit board in the electric component box is easily performed.

However, there is an image forming apparatus including an electric component box directly fixed to a rear portion of a main body so as to be removable. In such an image forming apparatus, when a service person is to perform maintenance work on a drive unit or the like arranged on a far side of the electric component box, it is required to remove the electric component box from the main body of the image forming apparatus. In general, the image data generating circuit board arranged in the electric component box is electrically connected to a control circuit board arranged outside the electric component box by a cable such as a flexible flat cable (hereinafter referred to as "FFC") or a harness that bundles electric wires. When a relay connector is provided in the electric component box, the image data generating circuit board and the relay connector in the electric component box are connected to each other by a cable, and the relay connector and the control circuit board outside the electric component box are connected to each other by another cable.

However, in a case of not using the relay connector in view of cost advantage, the cable connected to the control circuit board arranged outside the electric component box is connected to the image data generating circuit board in the electric component box through an opening portion or a cut-out portion formed in the electric component box. In such a configuration, when a service person is to remove the electric component box so as to perform maintenance work on the drive unit arranged on the far side of the electric component box, it is required to remove the cable connected to the image data generating circuit board before removing the electric component box. There is a problem in that, when the electric component box is removed in a state in which the cable is connected to the image data generating circuit board, the cable or the connector of the image data generating circuit board, to which the cable is connected, causes breakage.

SUMMARY OF THE INVENTION

According to an embodiment of the present invention, there is provided an image forming apparatus, comprising:

a main body including a rear face cover; a photosensitive member on which an image is formed; a transfer unit configured to transfer the image onto a sheet; a motor supported by a rear plate of the main body, the motor being configured to be used to rotate the photosensitive member; a box made of metal, which is fixed to a fixing portion of the main body with a screw, the box being located between the rear face cover and the motor; a first circuit board provided in the box; a second circuit board provided outside the box; and a flexible flat cable configured to connect the first circuit board and the second circuit board, wherein, in a state in which the flexible flat cable connects the first circuit board and the second circuit board, a position of the screw overlaps with the flexible flat cable in a direction orthogonal to the first circuit board.

Further features of the present invention will become apparent from the following description of exemplary embodiments with reference to the attached drawings.

DESCRIPTION OF THE EMBODIMENTS (Image Forming Apparatus)

Figure 1:
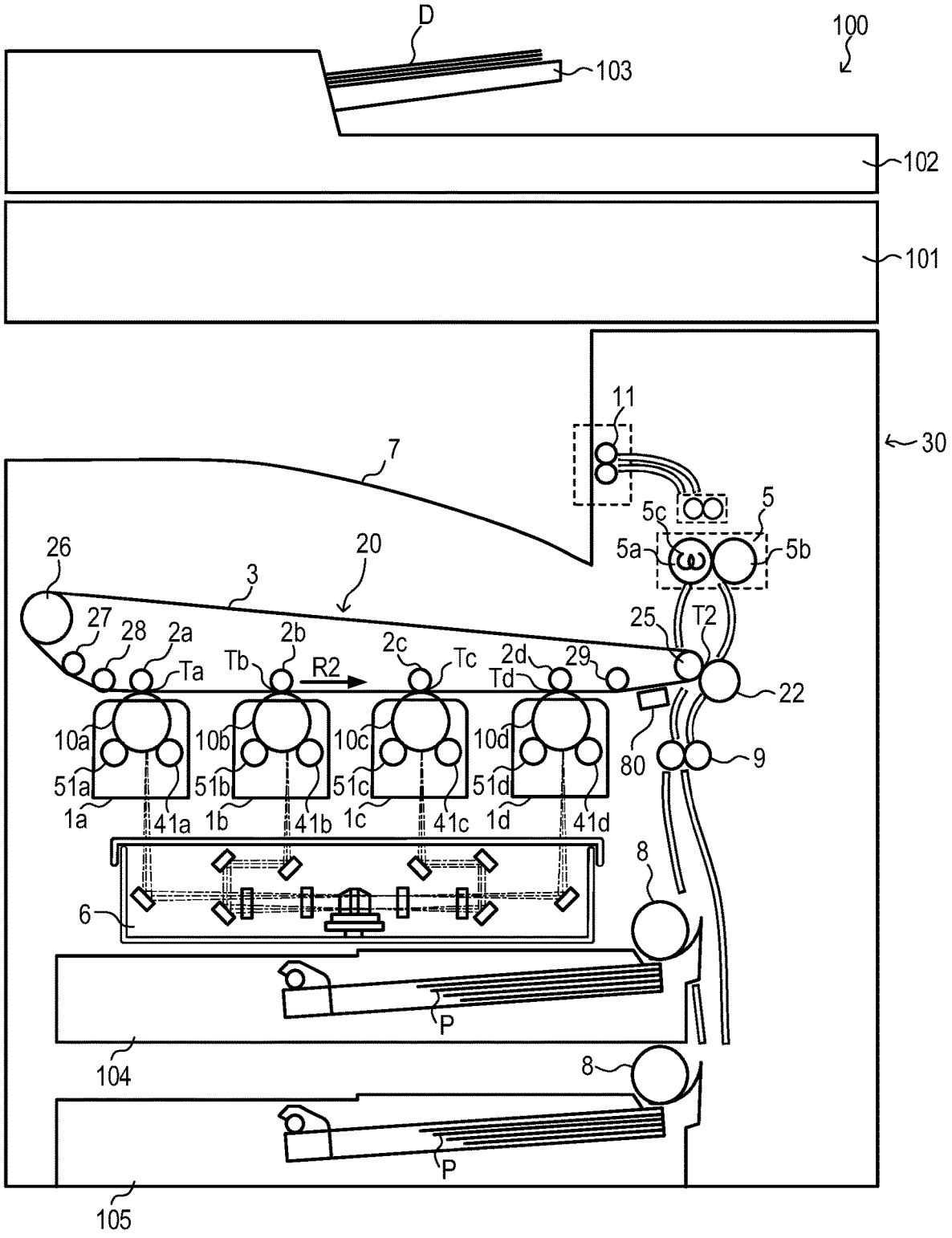
FIG. 1 is a sectional view of an image forming apparatus.

FIG. 1 is a sectional view of an image forming apparatus 100. As illustrated in FIG. 1, the image forming apparatus 100 is a full-color printer of a tandem intermediate transfer system in which image forming portions (image forming units) 1*a*, 1*b*, 1*c*, and 1*d* are arranged along a downward surface of an intermediate transfer belt 3. Further, the image forming apparatus 100 includes a document reading unit 101 and an automatic document conveying unit 102. The document reading unit 101 is configured to read an image of a document D. The automatic document conveying unit 102 is configured to automatically convey the document D placed on a document feeding tray 103 to the document reading unit 101. Feeding cassettes 104 and 105 are provided at a lower portion of the image forming apparatus 100. The feeding cassettes 104 and 105 have the same structure. Therefore, the feeding cassette 104 is described below, and description of the feeding cassette 105 is omitted. The feeding cassette 104 is drawable from a main body 30 of the image forming apparatus 100. A user can draw the feeding cassette 104 and replenish paper P to the feeding cassette 104, and push the feeding cassette 104 into the main body 30 to mount the feeding cassette 104 to the main body 30. A feeding roller 8 is configured to draw the paper P from the feeding cassette 104, separate the paper P one by one, and feed the separated pieces of paper P to registration rollers 9. The registration rollers 9 are configured to receive the paper P at a stopped state and keep the paper P thereat, and convey the paper P to a secondary transfer portion T2 in synchronization with a toner image formed on the intermediate transfer belt 3.

Figure 3:
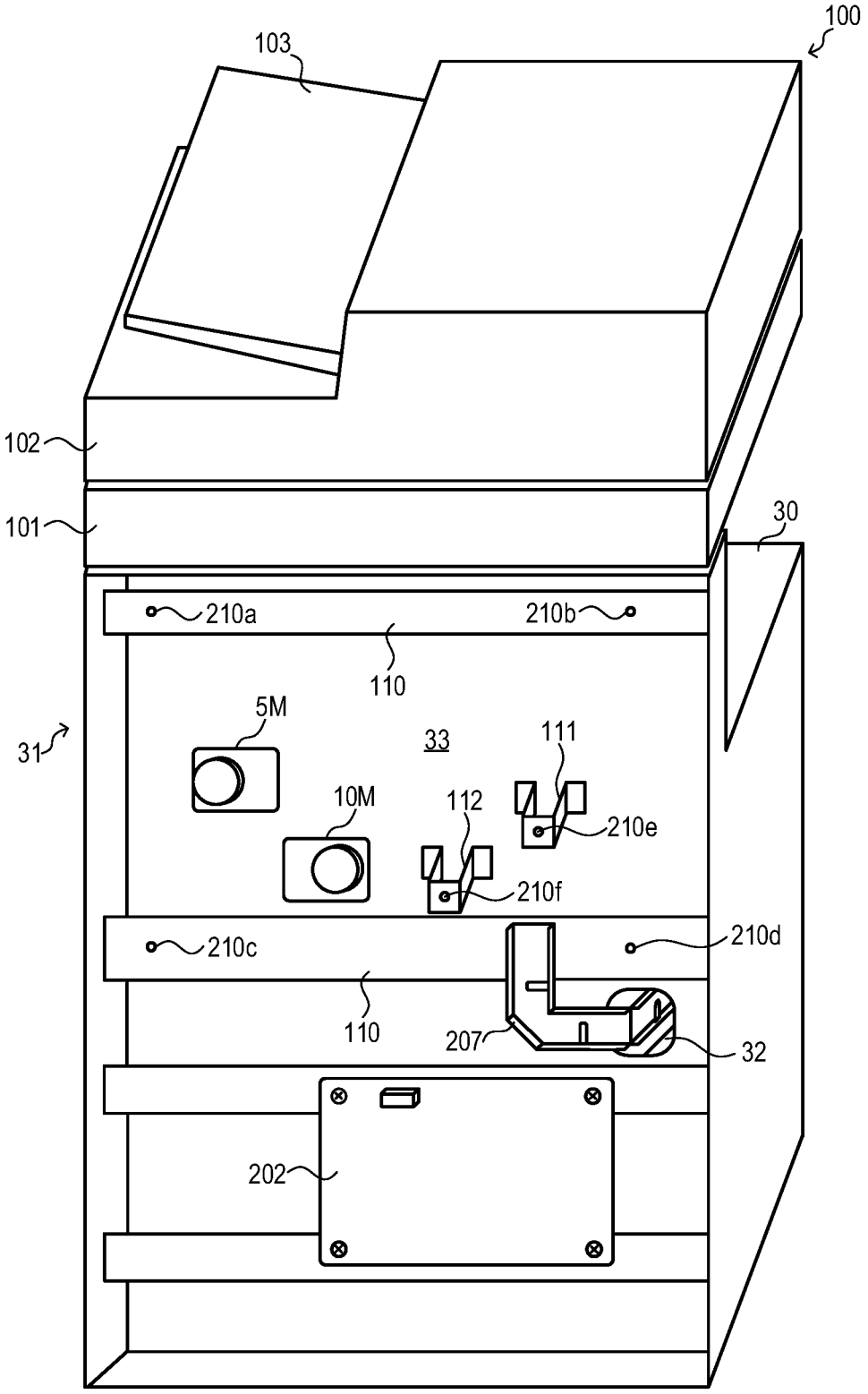
FIG. 3 is a rear view of the image forming apparatus in which an electric component box, a FFC, and a harness are removed.

The image forming portions 1*a*, 1*b*, 1*c*, and 1*d* have substantially the same configurations except that colors of toner used in developing units 51*a*, 51*b*, 51*c*, and 51*d* are yellow, magenta, cyan, and black, respectively, which are different from each other. In the following, the image forming portion 1*d* is described, and description of the image forming portions 1*a*, 1*b*, and 1*c* is omitted. The characters "a", "b", "c", and "d" added to the ends of the reference symbols represent yellow, magenta, cyan, and black, respectively. In the following description, the characters "a", "b", "c", and "d" added to the ends of the reference symbols are omitted unless otherwise necessary. The image forming portion 1 is assembled as a replacement unit (process cartridge) that is removably mounted to the main body 30. The image forming portion 1 includes a photosensitive drum (photosensitive member) 10. The photosensitive drum 10 has a photosensitive layer having a negative charge polarity on an outer peripheral surface of a cylinder made of aluminum. The photosensitive drum 10 is configured to rotate at a predetermined process speed when receiving a driving force from a drive motor (hereinafter referred to as "drum motor") 10M (FIG. 3).

The photosensitive drum 10 is charged to a uniform negative potential by a charging roller 41 provided in the image forming portion 1. An exposure device 6 is configured to perform scanning by a rotary polygon mirror with a laser beam, which is ON/OFF-modulated in accordance with scanning-line image data that is obtained by developing a decomposed color image of black, to thereby form an electrostatic latent image on the uniformly charged surface of the photosensitive drum 10. The electrostatic latent image formed on the surface of the photosensitive drum 10 is adhered with toner by the developing unit 51 provided in the image forming portion 1, and is reversely developed into a toner image. A primary transfer roller 2 presses the intermediate transfer belt 3 to form a primary transfer portion T between the photosensitive drum 10 and the intermediate transfer belt 3. A DC voltage having a positive polarity is applied to the primary transfer roller 2, and the toner image having a negative polarity, which is born on the photosensitive drum 10, is primarily transferred onto the intermediate transfer belt 3 passing through the primary transfer portion T.

An intermediate transfer unit 20 is arranged above the image forming portion 1. The intermediate transfer unit 20 integrally includes the intermediate transfer belt 3, a support mechanism configured to support the intermediate transfer belt 3, and a drive mechanism configured to rotate the intermediate transfer belt 3. The intermediate transfer unit 20 is a replacement unit that is removably mounted to the main body 30 of the image forming apparatus 100. The intermediate transfer belt 3 is supported while being stretched around a tension roller 27, a belt drive roller 26, a secondary transfer inner roller 25, and primary transfer tension rollers 28 and 29. The intermediate transfer belt 3 is rotated by the belt drive roller 26 in a direction indicated by the arrow R2. The intermediate transfer belt 3 is an endless belt member that does not expand and contract. Further, the intermediate transfer unit 20 includes a density sensor 80 configured to detect the density of the toner image on the intermediate transfer belt 3. The intermediate transfer unit 20 includes primary transfer rollers 2*a*, 2*b*, 2*c*, and 2*d* arranged so as to correspond to the image forming portions 1*a*, 1*b*, 1*c*, and 1*d*, respectively. The primary transfer rollers 2*a*, 2*b*, 2*c*, and 2*d* are urged by springs (not shown) toward the photosensitive drums 10*a*, 10*b*, 10*c*, and 10*d*, respectively. The primary transfer rollers 2*a*, 2*b*, 2*c*, and 2*d* cause the intermediate transfer belt 3 to be held in abutment against the photosensitive drums 10*a*, 10*b*, 10*c*, and 10*d* to form primary transfer portions Ta, Tb, Tc, and Td, respectively.

The secondary transfer inner roller 25 causes the inner surface of the intermediate transfer belt 3 to be tensed, and causes the intermediate transfer belt 3 to be held in abutment against the secondary transfer outer roller (transfer unit) 22 to form the secondary transfer portion T2. The secondary transfer inner roller 25 is provided in the intermediate transfer unit 20. The secondary transfer outer roller 22 is provided in the main body 30 of the image forming apparatus 100. A DC voltage having a positive polarity is applied to the secondary transfer outer roller 22 from a supply source (not shown) to form a transfer electric field between the secondary transfer outer roller 22 and the secondary transfer inner roller 25 connected to a ground potential.

A fixing device 5 includes a fixing roller (rotary member) 5*a* including a fixing heater 5*c*, and a pressure roller 5*b*. The pressure roller 5*b* is held in pressure contact with the fixing roller 5*a* to form a heating nip. The paper P is nipped by the heating nip and heated and pressurized while being conveyed, and the toner image is melted to be fixed onto the surface of the paper P, to thereby form a full-color image. The paper P having the full-color image formed thereon is delivered onto a delivery tray 7 by delivery rollers 11.

(Fixing Portions for Electric Component Box)

Figure 2:
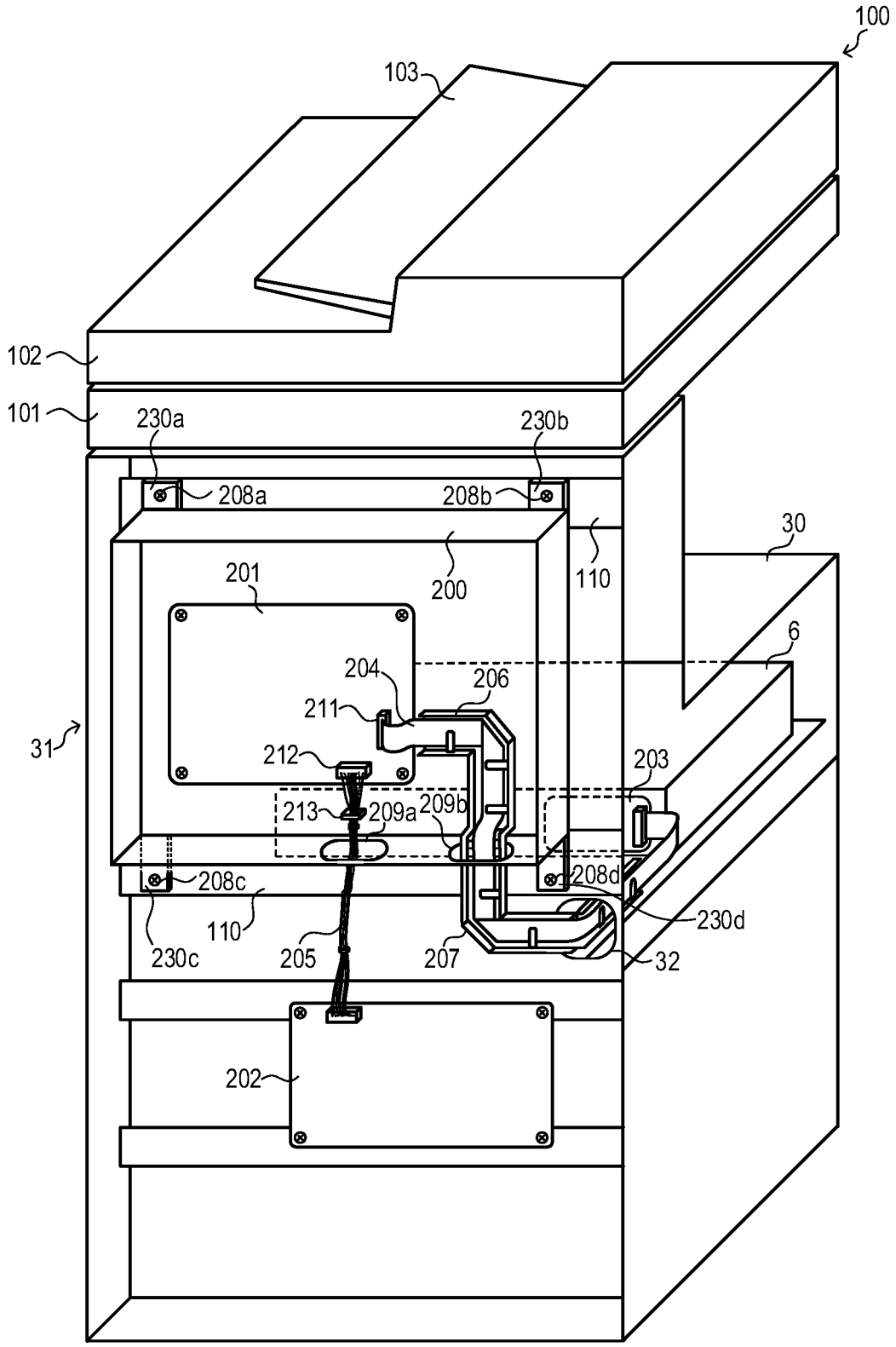
FIG. 2 is a rear view of the image forming apparatus.
Figure 5:
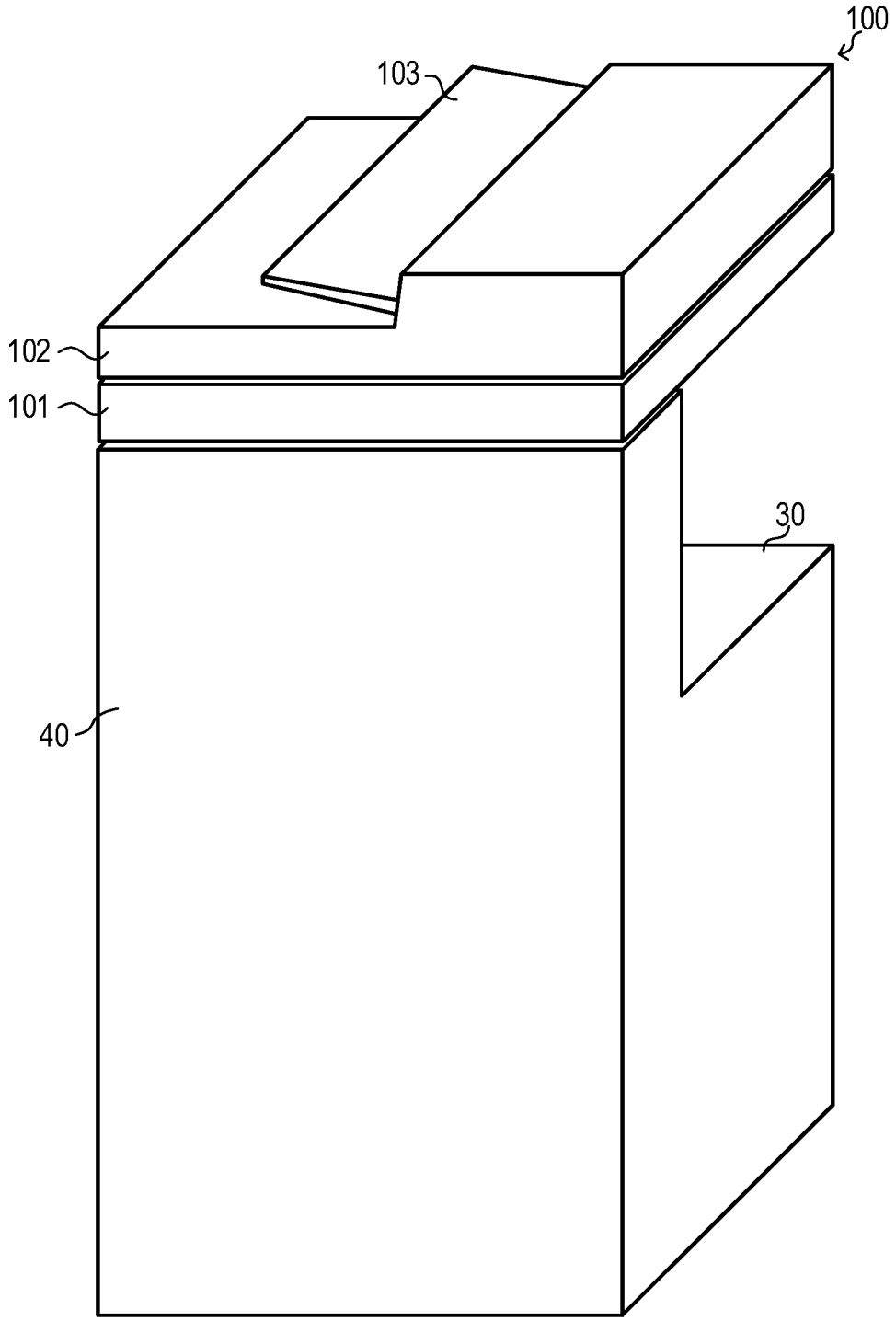
FIG. 5 is a rear view of the image forming apparatus.

Next, with reference to FIG. 2, FIG. 3, and FIG. 5, description is made of fixing portions 110 of the image forming apparatus 100 to which an electric component box 200 is mounted. The electric component box 200 is removably fixed to the main body 30 of the image forming apparatus 100. A service person can remove the electric component box 200 from the image forming apparatus 100 at the time of maintenance. The fixing portions 110 to which the electric component box 200 is mounted are provided to a rear portion 31 of the main body 30 of the image forming apparatus 100. FIG. 2 and FIG. 5 are rear views of the image forming apparatus 100. For description, in the illustration in FIG. 2, a rear face cover 40 of the image forming apparatus 100 is removed so that the interior of the image forming apparatus 100 can be seen from the rear side and the left side of the image forming apparatus 100. Further, in FIG. 2, a lid made of metal of the electric component box 200 is also removed so that the interior of the electric component box 200 can be seen. FIG. 5 is a perspective view for illustrating a state in which the rear face cover 40 is mounted to the rear side of the main body 30. The electric component box 200 is located between the rear face cover 40 (FIG. 5) and a rear plate 33 (FIG. 3). The electric component box 200 is removably fixed to the main body 30 of the image forming apparatus 100 with screws (fixing members) 208*a*, 208*b*, 208*c*, 208*d*, 208*e*, and 208*f*.

As illustrated in FIG. 2, the electric component box 200 made of metal, which accommodates an image data generating circuit board (first circuit board) 201, is mounted to the fixing portions 110 of the rear portion 31 of the image forming apparatus 100. This is because a frequency of a signal used in a circuit on the image data generating circuit board 201 has a value (predetermined frequency) that may cause electromagnetic wave noise. As illustrated in FIG. 3, the fixing portions 110 have screw holes 210*a*, 210*b*, 210*c*, and 210*d* into which the screws 208*a*, 208*b*, 208*c*, and 208*d* are screwed, respectively. The electric component box 200 is mounted to the image forming apparatus 100 in such a manner that extending portions 230*a*, 230*b*, 230*c*, and 230*d* that extend outward from the electric component box 200 are fixed to the fixing portions 110 with the screws 208*a*, 208*b*, 208*c*, and 208*d*. The image data generating circuit board 201 arranged in the electric component box 200 is electrically connected to a power supply control circuit board (second circuit board) 202 arranged outside the electric component box 200 by a harness (cable) 205. The power supply control circuit board 202 supplies power to the image data generating circuit board 201 through the harness 205, and communicates with the image data generating circuit board 201. In the power supply control circuit board 202, there is formed a circuit using a signal having a frequency lower than a predetermined frequency. That is, the frequency of the signal used in the circuit on the image data generating circuit board 201 is higher than a frequency of a signal used in a circuit on the power supply control circuit board 202. The harness 205 passes through a wire saddle 213 mounted to the electric component box 200, and passes through an electric component box opening portion 209*a* formed in the electric component box 200. The electric component box opening portion 209*a* may be a cut-out portion formed in the electric component box 200.

The image data generating circuit board 201 is further electrically connected to an exposure device control circuit board (second circuit board) 203 mounted to the exposure device 6 by a FFC 204. The image data generating circuit board 201 is configured to supply an image data signal to the exposure device control circuit board 203 through the FFC 204. In the exposure device control circuit board 203, there is formed a circuit using a signal having a frequency lower than a predetermined frequency. That is, the frequency of the signal used in the circuit on the image data generating circuit board 201 is higher than a frequency of a signal used in a circuit on the exposure device control circuit board 203. The FFC 204 is held by a guide 206 mounted to the electric component box 200, and passes through an electric component box opening portion 209*b* formed in the electric component box 200. The electric component box opening portion 209*b* may be a cut-out portion formed in the electric component box 200. The FFC 204 is further held by a guide 207 mounted to the main body 30, and passes through a main body opening portion 32 formed in the main body 30. As illustrated in FIG. 2, the FFC 204 is removably connected to the image data generating circuit board 201 by a connector 211. The harness 205 is removably connected to the image data generating circuit board 201 by a connector 212.

In order to remove the electric component box 200 from the fixing portions 110, it is required to remove the FFC 204 and the harness 205 from the image data generating circuit board 201. When the electric component box 200 is removed while the FFC 204 and the harness 205 remain connected to the image data generating circuit board 201, the FFC 204 and the harness 205 are caught on the electric component box opening portions 209*b* and 209*a*. In this case, there is a risk in that stress is applied to the FFC 204, the connector 211, the harness 205, and the connector 212 so that those cause breakage. In view of this, in this embodiment, there is provided a structure for preventing the FFC 204 and the harness 205 from being forgotten to be removed from the image data generating circuit board 201 before the electric component box 200 is removed from the fixing portions 110.

Figure 4A:
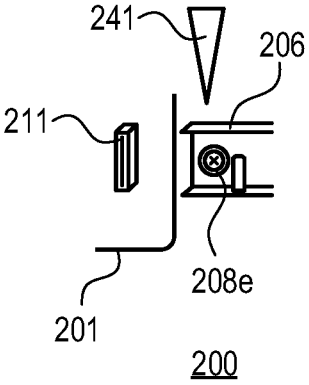
FIG. 4A, FIG. 4B, FIG. 4C, FIG. 4D, FIG. 4E, and FIG. 4F are partially enlarged views of an interior of the electric component box.

FIG. 3 is a rear view of the image forming apparatus 100 in which the electric component box 200, the FFC 204, and the harness 205 are removed. When the electric component box 200 is removed from the fixing portions 110, it is possible to visually recognize that a fixing motor 5M configured to drive the fixing device 5 and the drum motor 10M configured to drive the photosensitive drums 10 are mounted to the main body 30. The fixing motor 5M and the drum motor 10M are supported on the rear plate 33 (FIG. 4C). When the fixing motor 5M or the drum motor 10M is in failure, a service person removes the electric component box 200 from the fixing portions 110, and replaces the fixing motor 5M or the drum motor 10M that is in failure. Fixing portions 111 and 112, to which the electric component box 200 is fixed, are provided to the rear portion 31 of the image forming apparatus 100. The fixing portions 111 and 112 are fixed to the rear plate 33 (FIG. 4C and FIG. 4F) made of metal, which is provided to the main body 30. The fixing portions 111 and 112 have screw holes 210*e* and 210*f* into which the screws (fixing members) 208*e* and 208*f*, which are described later in FIG. 4A to FIG. 4F, are screwed.

In the following, with reference to FIG. 4A to FIG. 4F, description is made of which part of the interior of the electric component box 200 is fixed with respect to the fixing portions 111 and 112. FIG. 4A to FIG. 4F are partially enlarged views of the interior of the electric component box 200. FIG. 4A is an enlarged view of a part in the vicinity of the connector 211 of the image data generating circuit board 201, for illustrating a state in which the FFC 204 is removed. FIG. 4B is a view for illustrating a state in which the screw 208*e* illustrated in FIG. 4A is removed. The guide 206 and the electric component box 200 have a hole 221, through which the screw 208*e* configured to fix the electric component box 200 to the fixing portion 111 illustrated in FIG. 3, passes. The screw 208*e* is caused to pass through the hole 221, and the screw 208*e* is screwed into the screw hole 210*e* of the fixing portion 111 so that the electric component box 200 is fixed to the fixing portion 111.

FIG. 4C is a sectional view of the fixing portion 111. As illustrated in FIG. 4C, the screw 208*e* is located at a position overlapping with a laying route of the FFC 204 laid in the electric component box 200 as viewed along a mounting direction SD of the screw 208*e*. Therefore, in a state in which the FFC 204 is mounted to the connector 211, the screw 208*e* is hidden behind the FFC 204, and hence a service person cannot remove the screw 208*e*. Accordingly, a service person is required to pull out the FFC 204 from the connector 211 every time before the electric component box 200 is removed from the main body 30. When the connection between the FFC 204 and the image data generating circuit board 201 is canceled, that is, the FFC 204 is pulled out from the connector 211, a service person can visually recognize the screw 208*e*. A service person can remove the screw 208*e* every time before the electric component box 200 is removed from the main body 30. The FFC 204 is pulled out from the connector 211, and hence, when the electric component box 200 is to be removed from the main body 30, the FFC 204 is not caught on the electric component box opening portion 209*b*. Thus, breakage of the FFC 204 and the connector 211 can be prevented.

Figure 4D:
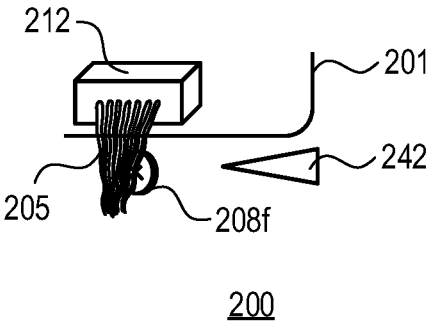
Figure 4B:
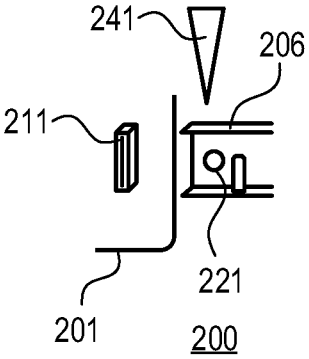
Figure 4E:
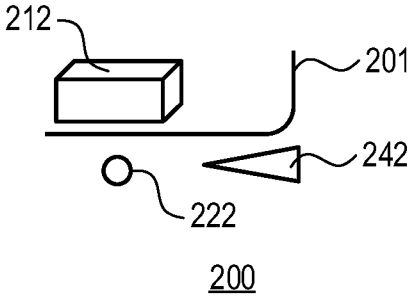
Figure 4C:
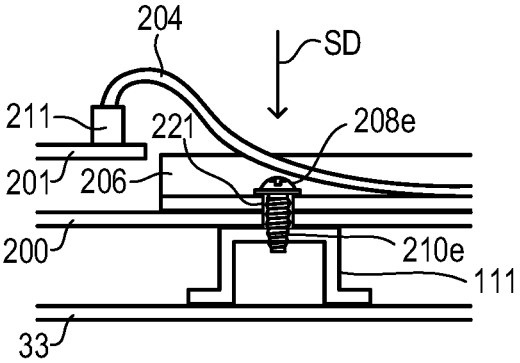

FIG. 4D is an enlarged view of a part in the vicinity of the connector 212 of the image data generating circuit board 201. FIG. 4E is a view for illustrating a state in which the harness 205 illustrated in FIG. 4D is removed from the connector 212, and the screw 208*f* is removed. The electric component box 200 have a hole 222, through which the screw 208*f* configured to fix the electric component box 200 to the fixing portion 112 illustrated in FIG. 3, passes. The screw 208*f* is caused to pass through the hole 222, and the screw 208*f* is screwed into the screw hole 210*f* of the fixing portion 112 so that the electric component box 200 is fixed to the fixing portion 112.

Figure 4F:
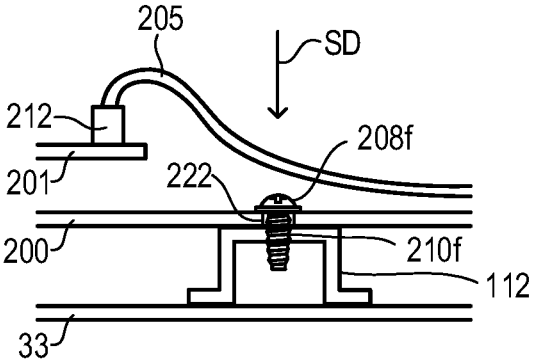

FIG. 4F is a sectional view of the fixing portion 112. As illustrated in FIG. 4F, the screw 208*f* is located at a position overlapping with a laying route of the harness 205 laid in the electric component box 200 as viewed along the mounting direction SD of the screw 208*f*. Therefore, in a state in which the harness 205 is mounted to the connector 212, the screw

208*f* is hidden behind the harness 205, and hence a service person cannot remove the screw 208*f*. Accordingly, a service person is required to pull out the harness 205 from the connector 212 every time before the electric component box 200 is removed from the main body 30. When the connection between the harness 205 and the image data generating circuit board 201 is canceled, that is, the harness 205 is pulled out from the connector 212, a service person can visually recognize the screw 208*f*. A service person can remove the screw 208*f* every time before the electric component box 200 is removed from the main body 30. The harness 205 is pulled out from the connector 212, and hence, when the electric component box 200 is to be removed from the main body 30, the harness 205 is not caught on the electric component box opening portion 209*a*. Thus, breakage of the harness 205 and the connector 212 can be prevented.

It is only required that at least one of the plurality of screws 208*e* and 208*f* mounted in the electric component box 200 be located at a position overlapping with a cable such as the FFC 204 or the harness 205 as viewed along the mounting direction SD. Further, it is preferred that at least one of the plurality of screws 208*e* and 208*f* be located at a position in the electric component box 200, which can be visually recognized when connection of the cable from the image data generating circuit board 201 is canceled. Further, as viewed along the mounting direction SD of the screw 208*e*, it only required that at least a part or the entirety of the screw 208*e* overlap with the FFC 204. It is preferred that a screw head of the screw 208*e* be hidden by 50% or more by the FFC 204. Further, as viewed along the mounting direction SD of the screw 208*f*, it is only required that at least a part or the entirety of the screw 208*f* overlap with the harness 205. It is preferred that a screw head of the screw 208*f* be hidden by 50% or more by the harness 205.

Further, the screw 208*e* is hidden behind the FFC 204, and hence, as illustrated in FIG. 4A and FIG. 4B, a mark such as a seal or an inscription 241 that indicates the position of the screw 208*e* may be provided to the electric component box 200 in the vicinity of the position of the screw 208*e*. Similarly, the screw 208*f* is hidden behind the harness 205, and hence, as illustrated in FIG. 4D and FIG. 4E, a seal or an inscription 242 that indicates the position of the screw 208*f* may be provided to the vicinity of the position of the screw 208*f*.

As described above, at least one screw 208*e* or 208*f* is located to overlap with the route of the FFC 204 or the harness 205 in the electric component box 200 as viewed along the mounting direction SD of the screw 208*e* or 208*f*. Therefore, it is required to cancel connection between the image data generating circuit board 201 and the FFC 204 or the harness 205 before at least one screw 208*e* or 208*f* is removed. Accordingly, a service person can remove the electric component box 200 from the main body 30 without forgetting to remove the FFC 204 or the harness 205 from the image data generating circuit board 201. According to this embodiment, a service person can remove the electric component box 200 without forgetting to cancel the connection of the cable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-069597, filed Apr. 1, 2019, which is hereby incorporated by reference herein in its entirety.

What is claimed is:

1. An image forming apparatus, comprising:
a main body including a rear face cover;
a photosensitive member on which an image is formed;
a transfer unit configured to transfer the image onto a sheet;
a motor supported by a rear plate of the main body, the motor being configured to be used to rotate the photosensitive member;
a box made of metal, which is fixed to a fixing portion of the main body with a screw, the box being located between the rear face cover and the motor;
a first circuit board provided in the box;
a second circuit board provided outside the box; and
a flexible flat cable configured to connect the first circuit board and the second circuit board,
wherein, in a state in which the flexible flat cable connects the first circuit board and the second circuit board, a position of the screw overlaps with the flexible flat cable in a direction orthogonal to the first circuit board.

2. The image forming apparatus according to claim 1, wherein the fixing portion is provided to the rear plate.

3. The image forming apparatus according to claim 1, wherein the box is removed from the fixing portion before the motor is replaced.

4. The image forming apparatus according to claim 1, wherein the box has an opening through which the flexible flat cable passes.

5. The image forming apparatus according to claim 1, wherein the box has a cut-out through which the flexible flat cable passes.

6. The image forming apparatus according to claim 1,
wherein the box includes a guide member configured to guide the flexible flat cable, and
wherein the position of the screw overlaps with the guide member in the direction orthogonal to the first circuit board.

7. The image forming apparatus according to claim 1, wherein a frequency of a first signal used in a first circuit on the first circuit board is higher than a frequency of a second signal used in a second circuit on the second circuit board.

8. The image forming apparatus according to claim 1,
wherein the first circuit board is configured to generate an image data signal for forming the image, and
wherein the second circuit board receives the image data signal generated by the first circuit board.

9. An image forming apparatus, comprising:
a main body including a rear face cover;
a photosensitive member on which an image is formed;
a transfer unit configured to transfer the image onto a sheet;
a motor supported by a rear plate of the main body, the motor being configured to be used to rotate the photosensitive member;
a box made of metal, which is fixed to a fixing portion of the main body with a screw, the box being located between the rear face cover and the motor;
a first circuit board provided in the box;
a second circuit board provided outside the box; and
a cable configured to connect the first circuit board and the second circuit board,
wherein, in a state in which the cable connects the first circuit board and the second circuit board, a position of the screw overlaps with the cable in a direction orthogonal to the first circuit board.

10. An image forming apparatus, comprising:

a main body including a rear face cover;

an image forming unit configured to form an image on a sheet;

a rotary member, which includes a heater configured to heat the image on the sheet, and is configured to fix the image onto the sheet;

a motor supported by a rear plate of the main body, the motor being configured to be used to rotate the rotary member;

a box made of metal fixed to a fixing portion of the main body with a screw, the box being located between the rear face cover and the motor;

a first circuit board provided in the box;

a second circuit board provided outside the box; and a flexible flat cable configured to connect the first circuit board and the second circuit board, wherein, in a state in which the flexible flat cable connects the first circuit board and the second circuit board, a position of the screw overlaps with the flexible flat cable in a direction orthogonal to the first circuit board.

* * * * *